United States Patent [19]

Frechtman

[11] 3,990,670

[45] Nov. 9, 1976

[54] CONVERTIBLE FRAME SUPPORT

[75] Inventor: Jean Frechtman, New York, N.Y.

[73] Assignee: Jeanmarie Gallery, Inc., New York, N.Y.

[22] Filed: Sept. 22, 1975

[21] Appl. No.: 615,214

[52] U.S. Cl. ..... 248/470; 248/463

[51] Int. Cl.[2] ..... A47F 7/14

[58] Field of Search ..... 248/497, 498, 469, 470, 248/471, 472, 463, 464, 465, 477, 495, 496

[56] References Cited

UNITED STATES PATENTS

| | | | |
|---|---|---|---|
| 590,071 | 9/1897 | Oldenbusch | 248/463 X |
| 1,400,150 | 12/1921 | Goble | 248/497 |
| 2,047,075 | 7/1936 | Kremen | 248/470 X |
| 2,483,114 | 9/1949 | Schoor et al. | 248/498 X |
| 3,908,955 | 9/1975 | Frechtman | 248/470 |

*Primary Examiner*—J. Franklin Foss
*Attorney, Agent, or Firm*—Gottlieb, Rackman, Reisman & Kirsch

[57] ABSTRACT

An improved support member for a frame carrying an article to be displayed is disclosed. The member is convertible between a hanging mode and a standing mode, with a hanger acting as the support element in the hanging mode and with a one-piece easel-type stand resting against a flat surface acting as the support element in the standing mode. The stand is held for pivoting action within tubular brackets on the hanger, and can maintain that position even when the hanging mode is being used. The upper edges of the planar stand pivot toward the hanger element as the lower stand portion pivots away, and contact between the upper stand edges and the hanger establishes a self-contained stopping position for the standing mode. The hanger element also includes a series of stepped cutouts to accommodate various surface attachment members.

7 Claims, 7 Drawing Figures

CONVERTIBLE FRAME SUPPORT

This invention relates to support devices in general and to apparatus for supporting framed or similar articles in multiple modes in particular.

This device is an improvement on the convertible support disclosed in my earlier co-pending application, Ser. No. 490,898, filed July 22, 1974. In that application, I described the various problems which have been encountered in the prior art with regard to supports and hangers that had been available heretofore. For example, I noted that it had previously been common to attach a hanging device onto a frame or even directly onto an article and to thereafter affix a hanging device such as a screw or nail onto a wall or similar surface and to interconnect the hanger and hanging device to support the framed article. An example of this type of hanger was the conventional "zig-zag" hanger, with a series of saw teeth on its lower edge. The problem with such a hanger was its limited usefulness in terms of its ability to be used with a variety of hanging devices and more significantly, the fact that it could only provide one type of display mode. It was noted in that application that other display modes, such as a standing display as is provided with an easel, had been known previously, but not in any combination with a hanger as well. Moreover, the prior art devices failed to consider the possible dual functioning of a hanging device, a problem overcome by my earlier application. The difficulties described in that application have existed for many years in this technology, and my earlier disclosure was directed at solving several of these problems.

Thus, my earlier application disclosed a device which provides a versatile solution for persons who want or need multiple support modes (i.e., hanging and standing) without necessarily wanting to purchase two separate hangers or to switch from one hanger to another when desiring to change the mode of support. In addition, I provided a device which established a relatively fixed position for support in the standing mode, by the action of the stand pivoting to a position where its upper edges contacted the frame or the display article itself. I also disclosed various means to assist in the centering of the framed article, both with respect to the frame itself and with respect to the wall or other surface when the hanging mode was involved.

However, I have now developed the present invention as a specific but definite improvement to my earlier invention, and to fulfill certain definite needs in this field. While my previous invention operates just as designed to meet its intended purposes, I have found that the present improvements can enhance the utilization of this device. Thus, it has been found desirable to utilize this invention to support fairly heavy frames and display articles, and that a different manner of interlocking and retaining the hanger and stand members would provide a more optimal supporting relationship for such frames and articles. I have also found that it may be more reliable for the standing mode position to be set and fixed by having the lower portion of the stand pivot away from the frame while the upper portion pivots toward and ultimately contacts the hanger element itself, rather than the frame or article. This insures a definite and certain stopping position for the stand, regardless of the shape or the fragility of the frame or article being supported.

The shape of the standing element as previously disclosed, while quite reliable and useful, can also cause some minor inconvenience. Thus, the "braking" action described in my copending application (which fixes the position in the standing mode) is enhanced by the angular relationship between the upper loops of the stand and its lower leg portions. However, this same angular relationship generally requires the stand to be removed from the hanger when not in use (i.e., when the hanging mode is involved). This is due to the inability of the stand to assume a flattened or planar position against the wall or other surface when the hanging mode is operative and the stand is not actually needed.

Another improvement desired with respect to my earlier invention relates to the surface-attachment elements adapted to fit within the hanger element by means of the bottom recess. Consistent with my desire to support larger frames or articles in both display modes, it is advantageous to have a wider recessed region in the hanger element to thereby accommodate a correspondingly wider variety of hanger attachments such as nails, screws, hooks, tacks, etc. For a heavier frame or article, a larger attachment device is required, often with a wide shank which could not readily be accommodated within the cutout of my earlier invention. At the same time, it is important to have a universal connecting region adapted to fit both small and large attachment members, since the present invention will continue to be used on frames of various sizes and weights.

It is therefore an object of this invention to obviate one or more of the aforesaid difficulties and to implement the indicated improvements.

It is also an object of this invention to provide a convertible support device adapted for use in supporting relatively heavy framed articles.

It is still another object of this invention to have a support hanger with a universal connecting region for various types of surface attachment members.

It is also an object of this invention to provide a stand for which the rest position is established by contacting an integral portion of the hanger support attached to the frame or article.

These and other objects and advantages of the invention will become apparent when a particular illustrative embodiment thereof is considered, wherein a combined hanger and standing element is disclosed. The hanger element is attached to the rear of a frame containing the article to be displayed, or in certain instances, it can be attached directly to the article itself. The hanger consists of a main central region having an upward point or projection adapted to assist in centering the nail or other hanging device on a vertical wall or other display surface and immediately beneath this centering projection, a series of stepped cut-outs adapted to accommodate a variety of different hanging devices. The stepped cut-outs narrow down to a triangular opening which can accommodate the shanks of all hanging devices whose diameter is less than the base of the triangular portion and which therefore fit within this portion. As in my earlier application, identified above, outward of this central region is a tranverse segment which is located between the main rear section and the frame of the article to be displayed. Another segment, perpendicular to this transverse segment and parallel to the main section, terminates in a pointed and triangular-shaped section adapted to pierce the frame and to be parallel to the transverse segment described above — it is this segment that actually penetrates the frame and achieves attachment of the hanger element thereto.

In my prior application, I disclosed oppositely disposed apertures in the transverse segments immediately outward of the main rear section of the hanger. In lieu of those apertures, which were designed to accommodate the spring-loaded arms of the stand portion, I disclose herein downward extensions of the main rear section adapted to be fabricated into hollow tubular segments on opposite sides of the stepped cut-outs described above. When fully formed, these tubular segments have their free ends substantially in contact with the inner surface of the main rear section of the hanger and define a largely cylindrical cavity on either side of the cut-outs to permit the insertion therethrough of the oppositely disposed and spring-loaded arms of the stand portion. In order to permit the arms to reach the tubular portions, a small arc of the transverse segments is cut away, thereby defining an opening through which the arms of the stand can fit within the tubular segments at the rear of the main hanger section.

When this invention is utilized in the hanging mode, either a straightforward nail, screw or other similar attachment device will be accommodated within the upper triangular cut-out portion, or else a similar conventional hanger will fit within the cut-out region. This invention discloses a number of stepped dimensions between which the shank of a flat hanger element can fit, of the type which was disclosed in FIG. 7 of my co-pending application. When the standing mode is to be utilized, the stand is prepared for attachment to the hanger by spreading its upper arms which are made of resilient material to permit a certain amount of spring-type biasing towards each other. The arms are spread apart sufficiently to permit their opposed ends to be disposed opposite the arc-like opening in the transverse segments of the hanger; thereafter, the arms are released and under the normal spring urging inherent in their resiliency, they enter the tubular retaining brackets on the inner rear surface of the hanger element. The stand is also made with an inverted U-shaped curve at its upper portion to provide a termination point for the entrance step into the tubular brackets. When the arms have reached the final entry point as determined by the location of the U-shaped upper edges of the stand, the preliminary standing mode has been reached and the pivoting action to reach the actual standing position can be commenced.

In order to achieve this position, the stand is pivoted such that its lower portions, which rest on the horizontal surface ultimately to be used for display purposes, are pivoted away from the frame. This of course pivots the upper U-shaped portion towards the frame. Because of the construction of this device, the upper U-shaped portion of the stand reaches its final engagement position when it contacts the segment of the stand which is connected to the transverse segment described above, that is, the connecting segment which is parallel to the main rear section of the hanger. This is the final rest position for the stand in the standing mode, since no further pivoting action by the stand is possible. Moreover, it is noted that this establishes a self-contained stopping position, whereby the frame or displayed article itself has not been involved in establishing the standing mode.

The stand of this invention is presented in a single plane or planar shape, which is somewhat different from the angular loops of the prior co-pending application. When it is desired to depart from the standing mode described immediately above and return to or initiate the hanging mode, it will no longer be necessary to remove the stand element from the hanger member by withdrawing the stand arms from the tubular brackets. All that is required under these circumstances is to pivot the stand back to a position where it is substantially parallel to the frame, thereby not causing any interference with the normal hanging mode operation. In that event, the stand will remain hanging from the tubular brackets, out of contact with either the frame or the wall, and out of sight of the observer viewing the framed article. Then, should it be desired to re-institute the standing mode, the framed article can simply be removed from the wall hanging attachment and the stand is there, ready for pivoting into its braking position and the re-establishment of the standing mode.

It is therefore a feature of an embodiment of this invention that a hanger is provided with tubular brackets into which the opposed spring-loaded arms of a stand element can be placed for secure holding and pivoting of the stand.

It is a further feature of an embodiment of this invention that a stand element is planar and can remain in place, without projecting rearwardly from the frame and while still attached to the tubular brackets of a hanger, even when the hanging mode is being used and the standing mode is not in use.

It is still another feature of an embodiment of this invention that a hanger element of a convertible frame support has a series of stepped openings to accept a variety of hanging surface-attachment devices, regardless of their size, thickness or placement.

It is yet another feature of an embodiment of this invention that a hanger element utilizes a positive projecting element centered between opposite ends of the hanger to provide auxiliary centering assistance in connection with ascertaining the correct location on a framed article for the placement of a support member.

These and other objects, features and advantages of this invention will become more readily understood when considered in connection with a presently preferred, but nonetheless illustrative, embodiment of the invention as explained in the following detailed description and as shown in the accompanying drawing, wherein.

Figure 1:
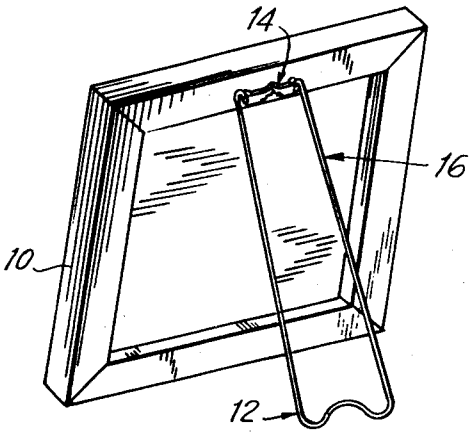
FIG. 1 is a perspective view of an illustrative frame outfitted with the present invention, with the hanger element affixed to the frame and the stand element mounted within the hanger element.
Figure 5:
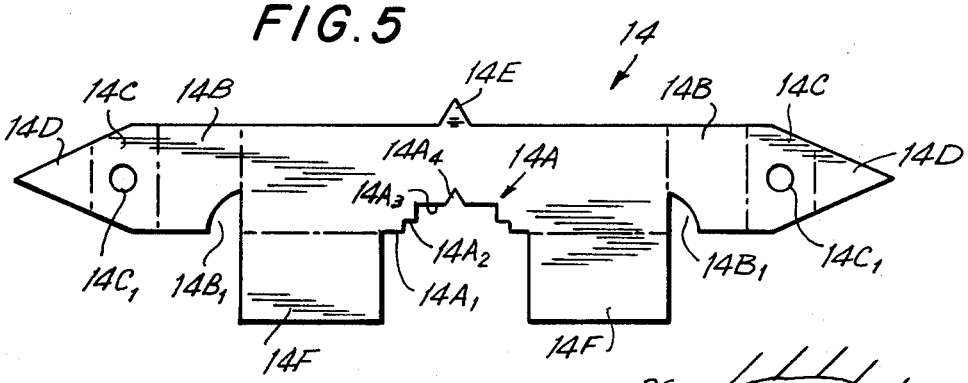
FIG. 5 is an overall layout view of the hanger element, illustrating the various segments thereof.

Considering the perspective view of FIG. 1, a frame 10 having the support 12 of this invention attached thereto is shown. As part of the overall support is a hanger element 14 which is attached to the upper portion of frame 10 and stand element 16 having downwardly projecting legs, with the stand 16 being attached as hereinafter described to the hanger element 14. The manner of attachment of stand 16 to hanger 14, as well as the component parts of both of elements 14 and 16, are shown in more detail in FIGS. 2 and 3. In addition, the separate components of hanger element 14 are also shown in somewhat greater detail in the layout view of FIG. 5. Accordingly, referring to FIGS. 2, 3 and 5, hanger element 14 consists of a recessed portion 4A in its lower edge. Recessed region 14A has a series of cut-outs which will be described hereinafter and which are identified in FIG. 5 as $14A_1$–$14A_4$. The other component portions of hanger element 14 are pairs of side segments 14B having quadrant-like cut-outs $14B_1$, a connecting portion 14C having an aperture $14C_1$ therein and a final segment 14D adapted to be inserted in a piercing fashion into the frame or the article to be displayed. There are appropriate bend lines between the various segments just described to permit them to be bent and shaped into appropriate transverse relationships between successive segments. Also forming a part of hanger element 14 is upward projection 14E to assist in the centering of the hanger element with respect to the frame and to also correctly position a hanger attachment member on a vertical wall surface. Finally, rectangular layout members 14F are adapted to be rolled up to form tubular brackets to accommodate the opposed legs of stand 16, as will be described in detail hereinafter.

Figure 2:
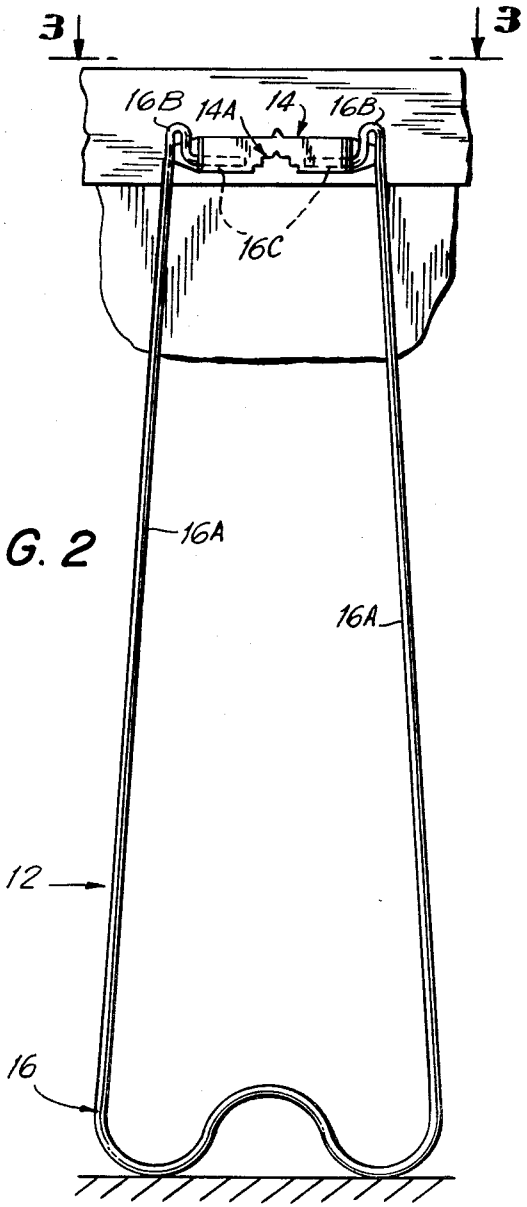
FIG. 2 is an enlarged rear view of the standing element, illustrating its general mode of attachment to the hanger element affixed to the frame.
Figure 3:
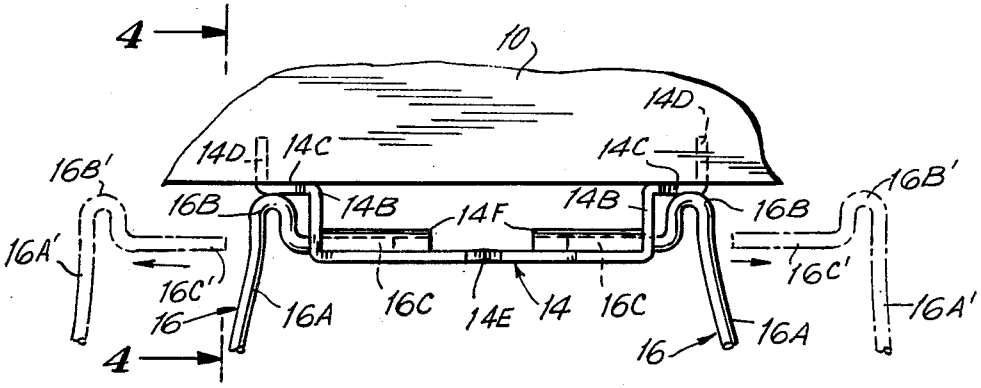
FIG. 3 is an enlarged fragmentary top view of a portion of the stand element, illustrating its insertion into the tubular brackets of the hanger element which has been affixed to the frame, taken along the perspective of line 3—3 of FIG. 2 in the direction of the arrows.
Figure 6:
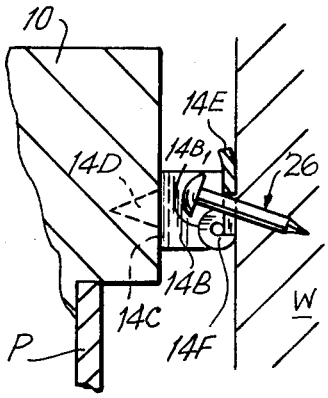
FIG. 6 is a side view of a frame to which the hanging element has been affixed, illustrating the hanging mode of the invention with respect to a vertical wall from which a nail projects.
Figure 7:
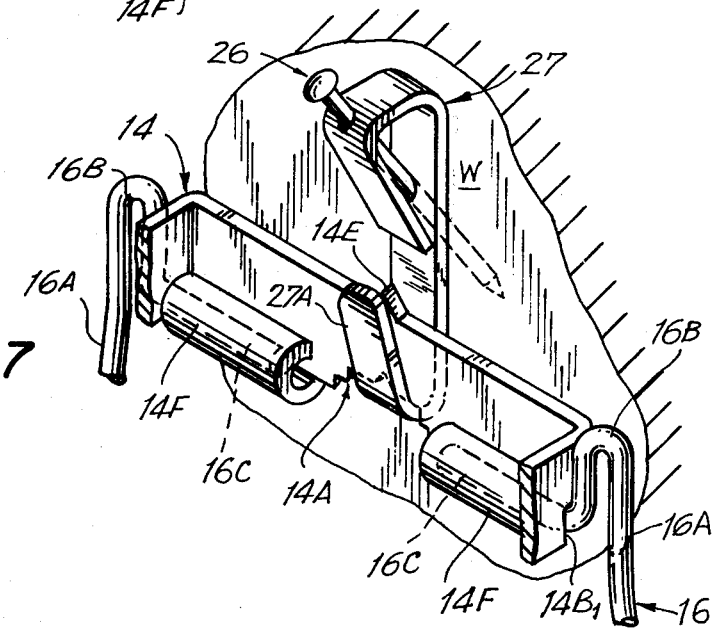
FIG. 7 is a fragmentary perspective view of the hanger element of this invention as used in connection with a conventional picture hanger, showing the stand remaining in place.

As best shown in FIGS. 2 and 3, hanger element 14 is attached to frame 10 through the use of pointed segment 14D. In order to place hanger element 14 into the proper segmented orientation to permit it to achieve the position shown in FIG. 3, segments 14B are bent to occupy a transverse relationship with the main rear portion, i.e., that portion of hanger element 14 from which projection 14E extends. In turn, apertured segment 14C is bent at right angles to transverse segment 14B and piercing segments 14D are also comparably bent to achieve the orientation illustrated in FIG. 3. Once the various bends are achieved as indicated, projection 14E can be utilized to assist in the centering of hanger element 14 on frame 10. This is done by measuring the width of the upper edge of frame 10 and dividing that dimension in half, thereby obtaining the center point. This point is then aligned by visual observation with the upper tip of projection 14E. Following this alignment step, hanger element 14 is attached to the upper edge of frame 10 as shown in FIGS. 1 and 2 by depressing pointed segments 14D into the frame with projection 14E aligned with the measured center point of the upper edge of frame 10. This provides for centering of hanger element 14 on the upper edge of frame 10. Since projection 14E is centered with respect to the outer edges of hanger element 14, it can also provide a point of reference for locating the correct position for a hanger device, such as a nail or screw, to be placed into a wall, as illustrated in FIGS. 6 and 7 and to be described hereinbelow.

Figure 4:
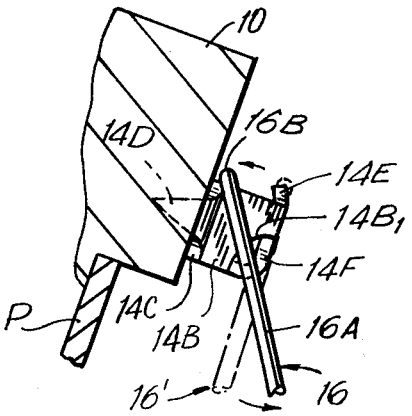
FIG. 4 is a fragmentary side sectional view illustrating the stand inserted within the tubular brackets at one side of the hanger element, showing the pivoting of the stand towards its contact position, taken along the line 4—4 of FIG. 3 in the direction of the arrows.

When hanger element 14 has thereby been attached to the upper edge of frame 10 as illustrated in FIGS. 2 and 3, the support provided by this invention is available for use in either the hanging mode (FIGS. 6 and 7) or the standing mode (FIGS. 1 and 4). The use of the invention in connection with the hanging mode will be described subsequently — to achieve the standing mode, stand 16 must be attached to hanger element 14 as is generally shown in FIG. 2. Thus, legs 16A of stand 16 must be spread apart, which will be possible in view of the resilient nature of the stand — the stand may be composed of a suitable resilient material, such as spring metal or the like or possibly a resilient plastic. As the legs 16A are spread apart in this fashion, the upper portion of stand 16 comprising inverted U-shaped segments 16B and opposed arms 16C will also be spread apart. As shown by the phantom representation in FIG. 3, designated by the reference numerals 16A′, 16B′ and 16C′, and as indicated by the outwardly directed arrows in FIG. 3, the upper portion of stand 16 is spread apart sufficiently far so that opposed legs 16C′ are opposite the respective entrance ports $14B_1$ to transverse segments 14B, with the entrance ports being visible in FIGS. 4–7. Upon release of the spread apart legs of stand 16, opposed arms 16C will pass through ports $14B_1$ in segments 14B and assume the positions indicated within tubular brackets 14F, as shown in FIG. 3. They will project into the tubular brackets 14F to the point where the inner segments of U-shaped portions 16B contact the outer surfaces of transverse segments 14B. This establishes a fixed position for the arms 16C and is the initial step in setting up the standing mode of the invention.

In order to complete the establishment of the correct position for the standing mode, stand 16 must be pivoted as indicated in FIG. 4. Thus, from the position indicated in FIG. 3 (and shown from the rear in FIG. 2), the bottom portion of stand 16 is pivoted away from the body of frame 10. This is indicated by the arrows in the counterclockwise direction at the bottom of FIG. 4 and just above the profile view of U-shaped segment 16B. This counterclockwise pivoting action continues until upper U-shaped portion 16B contacts rear hanger segment 14C which is in contact with the upper edge of frame 10. It is this stopping or braking position which is illustrated in FIG. 4. When that position is arrived at, as indicated in fragmentary form in FIG. 4 and as shown in perspective view in FIG. 1, the basic standing mode position has been achieved. It is noted that because of the flat or planar orientation of stand 16, the stopping position for element 16B is achieved by contact with another element of the invention itself, namely segment 14C. There is actually no contact between stand 16, and in particular segment 16B thereof, and frame 10. This is a desirable feature of the present invention, whereby the stopping or braking point is achieved in a self-contained fashion.

In order to utilize this invention in the hanging mode, whether with the stand 16 or without it (see below with respect to FIG. 7), the stand 16 is pivoted back in a direction opposite to that indicated in FIG. 4, that is, with the bottom of stand 16 moving towards the main body of frame 10. This is to disengage the standing mode position illustrated in FIG. 1 and to permit the hanging mode to be utilized. When the standing mode has been disengaged, with stand 16 being substantially parallel to the rear edge of frame 10 or picture element P (as illustrated in phantom at 16', FIG. 4), the hanging mode illustrated in FIGS. 6 and 7 may now be made operative.

Considering the view of FIG. 6, the position of nail 26 is selected with respect to wall or other surface W by the user of the invention. The precise point for locating nail 26 can be selected with the assistance of projection 14E of this invention. For example, in order to "test" the selection of a location for nail 26 in wall W, the user may align projection 14E with the proposed location for nail 26 and visually experiment with the selected location, thereby obtaining an approximate appreciation of the appearance of frame 10 when hung at the proposed location. If the location is acceptable, nail 26 can then be driven into wall W. It can be seen in FIGS. 6 and 7 that projection 14E is bent slightly away from wall W and toward frame 10 — this facilitates "spotting" the correct location for placement of the fastener (such as nail 26). Projection 14E may then be pressed flat along wall W after the spotting has been completed.

In the case of nail 26, having a cylindrical shank as is common in fasteners of that kind, the shank will generally be accommodated within the uppermost portion of cut-out region 14A of hanger 14. Thus, referring for the moment to FIG. 5, a series of stepped cut-outs is there illustrated, beginning with the widest $14A_1$ and extending through a series of stepped and gradually reduced width regions $14A_2$, $14A_3$ and finally ending in triangular portion $14A_4$. In most cases, considering relatively light frames which are capable of being supported on a wall by a narrow fastener such as nail 26, the shank thereof will be accommodated within the upper portion $14A_4$ of recessed region 14A. Once the nail 26 has been placed into wall W and the shank of nail 26 accommodated within triangular opening $14A_4$, the hanging mode for that particular type of fastener has been achieved.

It often occurs, however, that a substantially larger and heavier frame may have to be supported in the hanging mode to be used in connection with this invention. This will often require a wider nail or screw or, also quite often, a hanger of the type shown at 27 in FIG. 7. This type of hanger, which is attached to wall W by a nail 26 (utilizing the same reference numeral as in FIG. 6), is adapted for heavier and larger frames. It is attached to wall W in much the same manner as was described above with respect to nail 26 alone, namely by the centering assistance of upward projection 14E of hanger element 14. The use of projection 14E assists in the selection of the penetration point for nail 26 of hanger 27. Once that position has been achieved, the U-shaped hooked portion 27A of hanger 27 is then fitted into region $14A_2$ of recessed portion 14A. It is apparent to those skilled in the art that when wider hooked parts 27A are to be utilized, the region designated as $14A_1$ can receive such hooked portions; similarly, should the hook 27A be narrower than illustrated in FIG. 7, the recessed region $14A_3$ can accommodate such a hook.

Another aspect of this invention is the fact that I have now dispensed with the requirement to remove stand 16 when only the hanging mode is being used. This is illustrated in part in FIG. 7 where a fragmentary portion of stand 16 is illustrated as remaining attached to hanger 14 despite the use of the hanging mode involving hanger 27. In particular, it is noted from FIG. 7 that oppositely disposed spring arms 16C remain within tubular brackets 14F, even though it is the hanging mode which is being illustrated in FIG. 7. In this posture, stand 16 is at the orientation shown at 16' in FIG. 4, namely substantially parallel to the rear of frame 10 (not shown in FIG. 7) and correspondingly substantially parallel to wall W as illustrated in FIG. 7. The only limitation, of course, in permitting stand 16 to remain attached to hanger 14 while the hanging mode is operative is that the length of stand 16 cannot exceed the height of frame 10 to which hanger element 14 is attached — in such an event, the bottom of stand 16 would project out from the lower edge of frame 10 and be visible by someone viewing the front of picture P. It will generally be arranged by the user of this invention that frames on which the invention is to be applied in this fashion will be greater in height than stand 16 is in its length between its upper and lower edges.

It should also be noted that this invention provides auxiliary reinforcing means to assist in the use of the invention with respect to heavier and larger frames. The use of tubular brackets 14F is an important aspect of this support feature. When arms 16C are inserted through ports $14B_1$ and thus into tubular brackets 14F, they achieve a substantially snug fit therein. However, such fit does permit the pivoting action of stand 16, as described above with respect to FIG. 4. But when such pivoting action has been terminated, thereby achieving the position shown in FIG. 4 and also in FIG. 1, the contiguous relationship between arms 16C and the inner surface of tubular brackets 14F achieves a strong interconnection between stand 16 and hanger 14, permitting relatively heavy frames to be supported in the standing mode. There is also additional support means provided for the hanging mode, namely by virtue of apertures $14C_1$ in segments 14C which are arranged to be flush against the rear surface of frame 10. As shown in FIGS. 3, 4 and 6, segments 14C rest against the rear surface of the upper edge of frame 10, and the presence of apertures $14C_1$ therein would permit a small nail or tack to be inserted through the aperture and into frame 10. This could reinforce the holding action between hanger element 14 and frame 10 in the case of extremely heavy frames. Thus, when the hanging mode illustrated in FIGS. 6 and 7 is achieved through the use of this invention, the presence of an additional fastener through apertures $14C_1$ on both sides of hanger 14 could reinforce the strength of the hanging mode of this invention.

It will be appreciated by those skilled in the art that a number of variations in this invention may be achieved within the basic invention itself. Thus, tubular brackets 14F are illustrated in FIGS. 3 and 7 as having been bent upward and toward the frame 10, thereby establishing tubular brackets 14F on the "inside" of the rectangular space defined by the main rear segment of hanger 14 and by the opposed transverse segments 14B and the rear edge of the upper surface of frame 10. However, from the layout position indicated in FIG. 5, it is also possible to bend segments 14F upward on the "outside" of hanger element 14, thereby forming tubular brackets 14F on the opposite side of the main rear segment of hanger element 14 — that is, opposite from the position illustrated in FIG. 3.

It is to be understood that the foregoing embodiments are merely illustrative of the application of the principles of this invention. Numerous variations may be devised by those skilled in the art without departing from the spirit or scope of the invention.

What is claimed is:

1. A device supporting an article having a frame comprising a stand element supporting said article in a first display mode, said stand including a pair of arms formed of resilient material and having a lower rest portion and an upper attachment portion, and a hanger element for supporting said article in a second display mode independently of said stand element and in said first display mode in conjunction with said stand element, said hanger element being attached to said article and including coupling means for receiving said upper attachment portion of said stand element in said first display mode, wherein said upper attachment portion of said stand includes a pair of opposed leg members each connected to respective ones of said arms, and wherein said coupling means of said hanger element includes a pair of segments located in planes transverse to the plane of said article and each transverse segment having an aperture corresponding to each of said leg members, a central segment connecting said transverse segments and formed with a substantially tubular holding bracket aligned with each of said apertures, and side segments formed outwardly of each of said transverse segments, each of said apertures permitting one of said leg members to be accommodated therethrough and into a snug fitting relationship with a respective tubular holding bracket, whereby said stand is pivotable away from said article until said upper attachment portion contacts said side segments to restrain further movement of said stand away from said article to thereby define said first display mode with said lower rest portion of said stand in contact with a substantially horizontal support surface, said device being adapted for use in conjunction with a wall fastener mounted on a substantially vertical wall, and wherein said central segment of said hanger element includes a centered cut-out having a plurality of stepped receiving positions accommodating said wall fastener therein to define said second display mode.

2. A device in accordance with claim 1 wherein a first of said receiving positions comprises a recess from the edge of said central segment, and successive ones of said receiving positions comprise recesses from the next respective outer recess, and wherein the last of said positions comprises a notch adapted to receive said wall fastener therein.

3. A device in accordance with claim 1 wherein said upper attachment portion includes an inverted U-shaped segment connecting each of said leg members and corresponding ones of said arms, said U-shaped segment adapted to contact said transverse segment to limit the inward movement of the corresponding ones of said leg members into the respective tubular holding bracket, and said arms and said lower rest portion and said upper attachment portion being co-planar with each other.

4. A device in accordance with claim 3 wherein each of said tubular holding brackets is formed on the side of said hanger element facing said article.

5. A device in accordance with claim 3 wherein each of said tubular holding brackets is formed on the side of said hanger element opposite said article.

6. A device in accordance with claim 3 wherein the upper portion of each said inverted U-shaped segment contacts respective ones of said side segments to establish said first display mode.

7. A device in accordance with said claim 3 wherein said inverted U-shaped segments are adapted to pivot away from said side segments to establish a suspension position for said stand, said stand remaining in said suspension position with said opposed leg members being held by said tubular holding brackets during the operation of said second display mode.

* * * * *